US007845717B2

(12) United States Patent
Leng

(10) Patent No.: US 7,845,717 B2
(45) Date of Patent: Dec. 7, 2010

(54) STOOL WITH TELESCOPIC LEGS

(75) Inventor: Luhao Leng, Xiamen (CN)

(73) Assignee: New-Tec Integration (Xiamen) Co., Ltd., Xiamen (CN)

( * ) Notice: Subject to any disclaimer, the term of this patent is extended or adjusted under 35 U.S.C. 154(b) by 0 days.

(21) Appl. No.: 12/414,873

(22) Filed: Mar. 31, 2009

(65) Prior Publication Data

US 2009/0261627 A1 Oct. 22, 2009

(30) Foreign Application Priority Data

Apr. 16, 2008 (CN) ..... 2008 2 0102000 U

(51) Int. Cl.
*A47C 4/00* (2006.01)
*A47C 9/00* (2006.01)

(52) U.S. Cl. ..... 297/16.1; 297/42; 297/461

(58) Field of Classification Search ..... 297/16.1, 297/42, 56, 440.24, 461, 462; 108/118, 120
See application file for complete search history.

(56) References Cited

U.S. PATENT DOCUMENTS 1,600,248 A * 9/1926 Rosenthal et al. ..... 297/56
1,760,008 A * 5/1930 Schermerhorn ..... 297/56
2,540,875 A * 2/1951 Genge ..... 108/120
2,711,787 A * 6/1955 Hallowell, Jr. et al. ... 297/451.1
4,967,672 A * 11/1990 Leather ..... 108/120
5,454,575 A * 10/1995 Del Buono ..... 280/35
5,478,138 A * 12/1995 Yu ..... 297/461
5,893,604 A * 4/1999 Yao ..... 297/16.1
6,332,646 B1 * 12/2001 Tseng ..... 297/16.1
2004/0245810 A1 * 12/2004 Tseng ..... 297/56
2006/0119156 A1 * 6/2006 Crue ..... 297/344.18
2007/0228780 A1 * 10/2007 Grace ..... 297/45

* cited by examiner

*Primary Examiner*—Sarah B McPartlin
(74) *Attorney, Agent, or Firm*—Rabin & Berdo, P.C.

(57) ABSTRACT

A stool with telescopic legs, including a seat and four legs that have a first two legs disposed on a first side of the seat, and a second two legs disposed on a second side of the seat opposite to the first side. The four legs are of the same length. A first end of each of the four legs is hinged to the seat. The first two legs respectively pivotally cross the second two legs, thereby forming two crossing joints that are connected by a cross beam. The second two legs each has a telescopic rod structure, such that, when the stool is folded, the telescopic rod structure extends, and second ends of the first and second two legs opposite to the first ends are aligned.

13 Claims, 5 Drawing Sheets

STOOL WITH TELESCOPIC LEGS

FIELD OF THE INVENTION

The present invention generally relates to a stool, and, more particularly, to a stool with telescopic legs.

BACKGROUND OF THE INVENTION

No matter at home, office or other places, stools are used for relaxing in daily life for their compact size and portability. Moreover, the foldable stools are being used more widely, because a foldable stool has two states of a collapsed position and an open position, it can be opened when it is in use, and can be folded to save space when it is not in use. This stool is portable, and is convenient to be transported.

There are two existing ways to fold a stool. One way is to fold both the legs of the stool and the seat to the middle symmetrically. The other way is, like the foldable chair, both of the legs can be folded together, and then the seat is folded close to the legs. After being folded in the first way, the heights of two legs are almost the same. However, as the seat is also folded to the middle, the two legs cannot be sufficiently close to each other. It still takes much space and is inconvenient to store. In the second way, although the legs can be close to each other, and the seat can be close to the seat furthest, but the heights of the legs are different, the stool is inconvenient to be stored and transported.

Thus, we need a new kind of stool to solve the aforementioned problems and defects.

SUMMARY OF THE INVENTION

To overcome the defects that the seat and the front legs cannot be close to one another and the lengths of legs are different after the stool is folded, the present invention provides a stool with telescopic legs, where two of legs have a telescopic rod structure. When the stool is folded, the legs with telescopic rods can outstretch till the stool is folded completely. After being folded, the four legs have the same height and close together completely with each other, and the seat is attached completely to the legs, by which the engaged space will be saved further and the stool is convenient to be arranged, stored and transported.

The object of the present invention is achieved by providing:

A stool with telescopic legs, comprising a seat and four legs, wherein one end of the four legs is hinged to the seat, the two legs in a side are pivotally cross to other two legs in the other side respectively, and the two crossing joints are connected by a cross beam, and two parallel legs have the telescopic rod structure.

The seat of the stool can be of a circular, square, rectangular or elliptical shape.

The seat of the stool is hinged to the legs through connecting piece mounted on the back of the seat of the stool by rivets.

The telescopic rod bar structure includes: a hollow outer rod; a sliding rod which can slide inside the outer rod; and a screw thread connecting structure for fixing the sliding rod.

The screw thread connecting structure includes: fixing apertures disposed both on the outer rod and the sliding rod; screws used for locking the fixing apertures, the sliding rod and the outer rod.

The sliding rod is hinged to the connecting piece mounted on the back of the seat of the stool by riveting.

The length of the sliding rod is slightly longer than the distance between the cross beam to the connecting piece.

A cross bar is disposed between the lower portions of the two legs with telescopic rod structures.

Another cross bar is disposed between the lower portions of the other two legs without telescopic rod structures.

Said cross bars are in a same height of the legs. i.e. the distance between the cross bar to the ends (i.e. ending points) opposite to the seat of the legs with telescopic rod structure, is the same as the distance between another cross bar to the ends (i.e. ending points) opposite to the seat of another two legs without telescopic rod structures.

Advantages: This invention is a stool with telescopic legs, with two parallel legs having the telescopic rod structures. When the stool is in use, the sliding rod of the telescopic rod structure of the two parallel legs is fixed in the outer rod. When the stool is folded, the sliding rod of the telescopic rod structure of the two parallel legs slides out of the outer rod. Meanwhile, the seat of the stool folds downwards till four legs attached together completely. At this position, the seat of the stool is attached to the legs completely too, thus the space engaged by the stool is saved to the maximum extent. Moreover, because the telescopic structure and the four legs of the folded stool are in the same height, the stool is more convenient to be placed, stored and transported. The structure of this invention is simple and easy to be manufactured, and the space engaged by the folded stool can also be saved.

BRIEF DESCRIPTION OF THE DRAWINGS

The present invention will be described with greater specificity and detail through the use of the accompanying drawings and detailed embodiment, in which.

DESCRIPTION OF THE PREFERRED EMBODIMENTS

Figure 1:
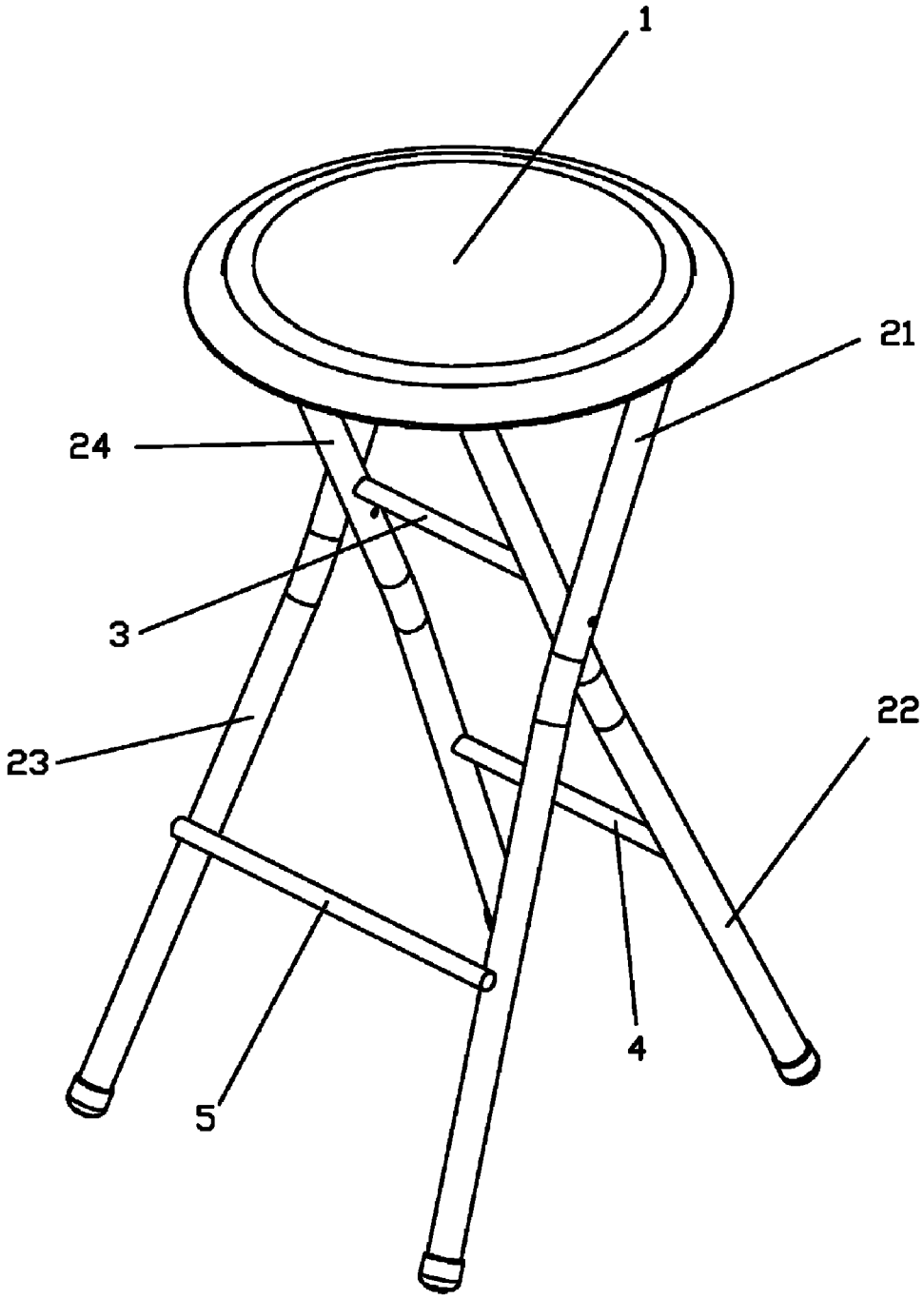
FIG. 1 is a perspective view of the stool in an unfolded in-use position in a preferred embodiment of the present invention.
Figure 2:
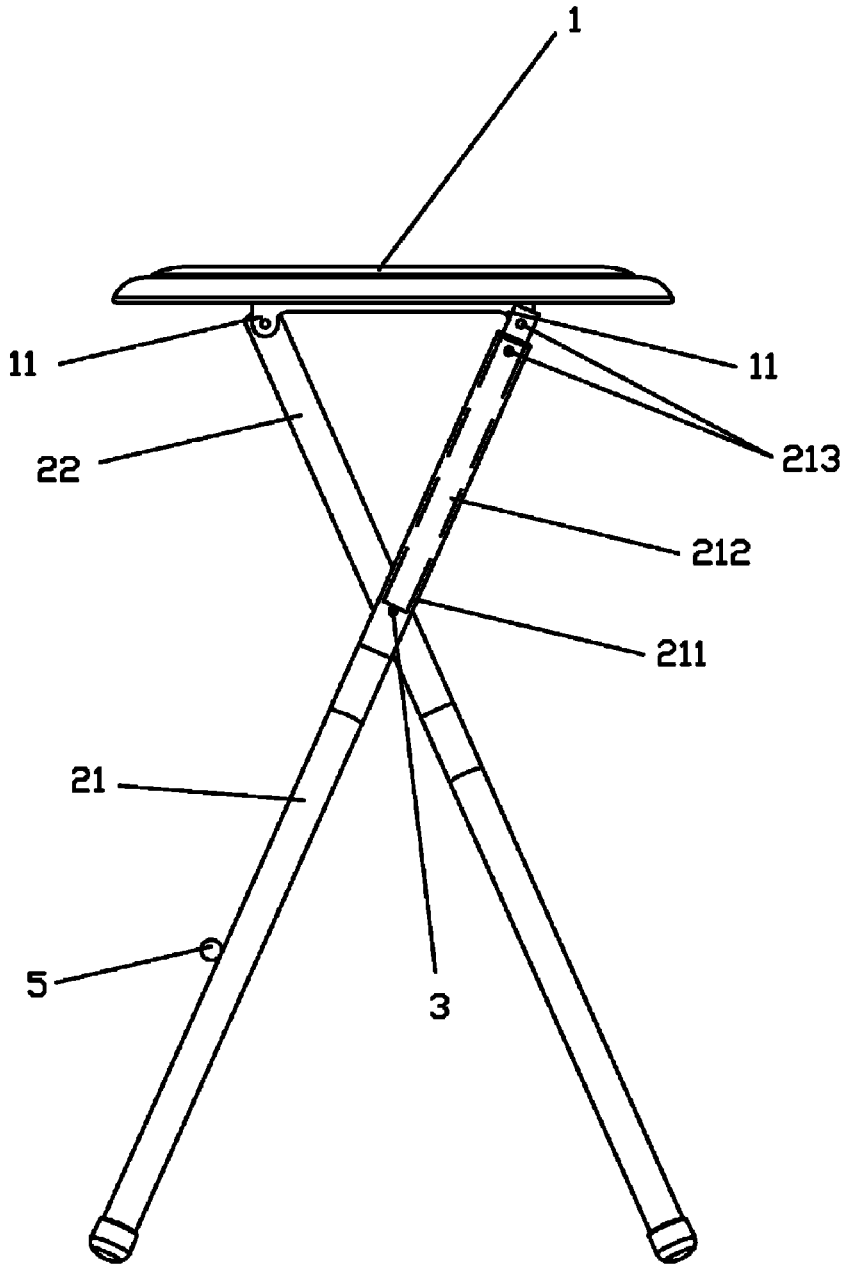
FIG. 2 is a side view of the stool in an unfolded in-use position in a preferred embodiment of the present invention.

In the following embodiment of the present invention, the stool is with a circular seat, without limitation, the seat with other shapes is also usable. Referring to FIG. 1 and FIG. 2, which are a perspective view and a side view of the stool in an unfolded position in the embodiment respectively. A stool with telescopic legs includes a seat 1 and four legs 21,22,23,24. The seat 1 is hinged to the legs 21,22,23,24 through the connecting pieces 11 disposed on the back of the seat 1 via rivets. The legs 21,22,23,24 make displacement with the seat 1. The legs 21,22 pivotally cross each other, and the legs 23,24 also pivotally cross each other. The two crossing point are connected by a cross beam 3. The legs 21,23 are parallel with each other, as do the legs 22,24. A crossbar 5 is disposed between the lower portions of legs 21 and 23 to connect the leg 21 with leg 23, the crossbar 5 being mounted on the surface of the leg 21 and 23. A crossbar 4 is disposed between leg 22 and 24 to connect the leg 22 with leg 24, the cross bar 4 being inserted in the leg 22 and 24. The distance between the cross bar 5 and the ends of legs 21 and 23 opposite to the seat, is the same as the distance between the cross bar 4 and the ends of legs 22 and 24 opposite to the seat, i.e. the cross bar 4 and the bar 5 are in parallel, and they are at the same position of the legs 21, 23 and the legs 22,24, so that they will be closed together when the stool is folded. Legs 21, 23 have structures of a telescopic rod, which are shown clearly in FIG. 2. The telescopic rod structures of the legs 21 includes a hollow outer rod 211, a sliding rod 212 that can slide inside the outer rod 211, and a screw thread connecting structure used to fix the sliding rod 212.

The screw thread connecting structure includes: a fixing apertures 213 disposed both on the outer rod and the sliding rod, and screws used for locking the fixing apertures, the sliding rod and the outer rod. The sliding rod 212 can be slid in the outer rod 211 by adjusting the fixing apertures 213 and the screws. The length of the sliding rod 212 is slightly longer than the length of the portion of the leg 21 from the cross beam 3 to the connecting piece 11 on the seat, where the sliding rod 212 is disposed inside the portion of the outer rod 211 which is upper to the cross beam 3. The leg 21 is hinged to the connecting piece 11 via the outer rod 212. FIG. 2 is a view from the side of the legs 21,22, so the legs 23,24 cannot be seen. Because the structures of 21, 22 are the same as 23,24 respectively, so the structures of the legs 23,24 are not described repeatedly here. Moreover, the shape of the seat 1 can be circular, square, rectangular or elliptical.

Figure 3:
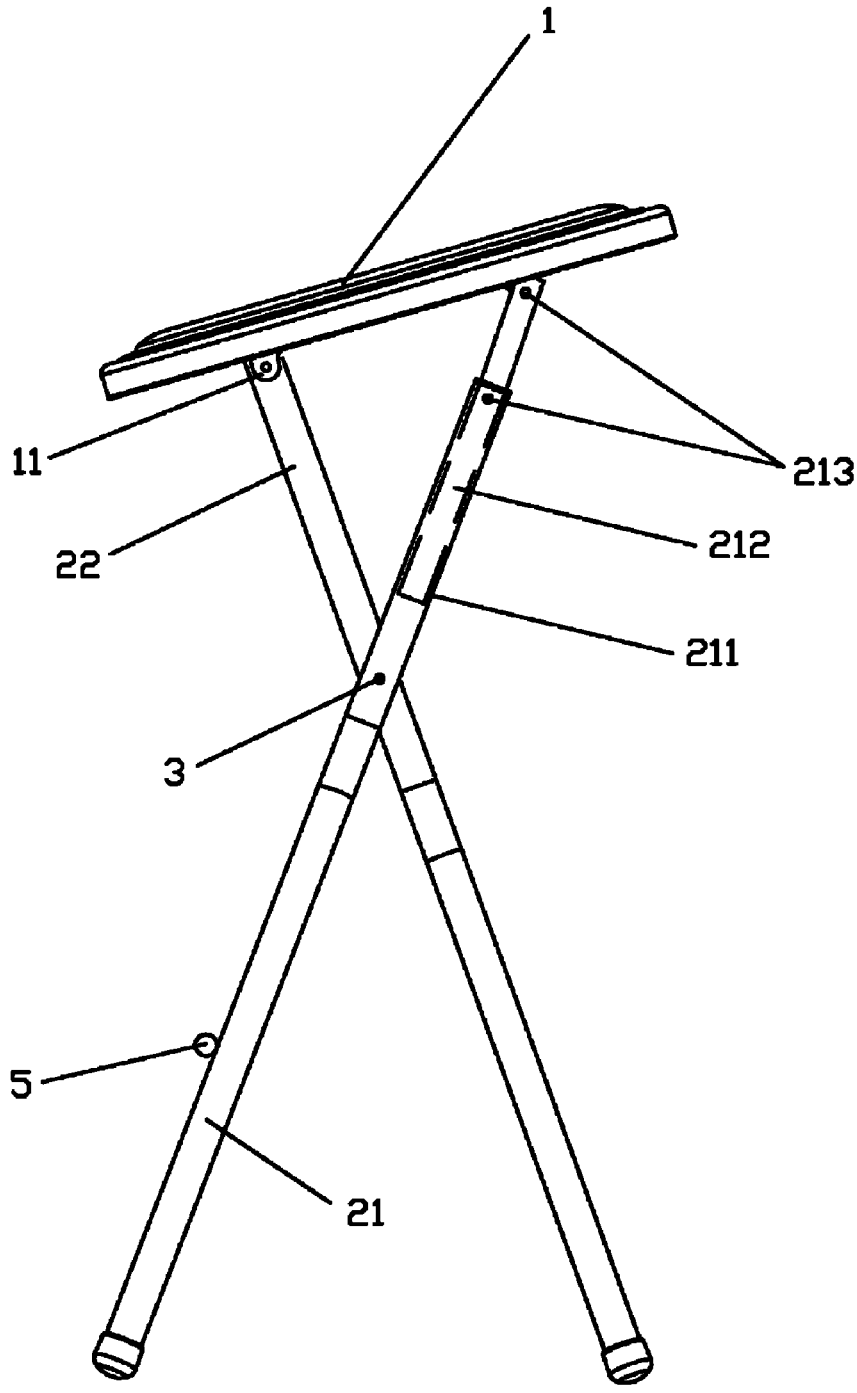
FIGS. 3 and 4 are side views of the stool in a position of between folded and unfolded, and a position of folded respectively, in a preferred embodiment of the present invention.
Figure 4:
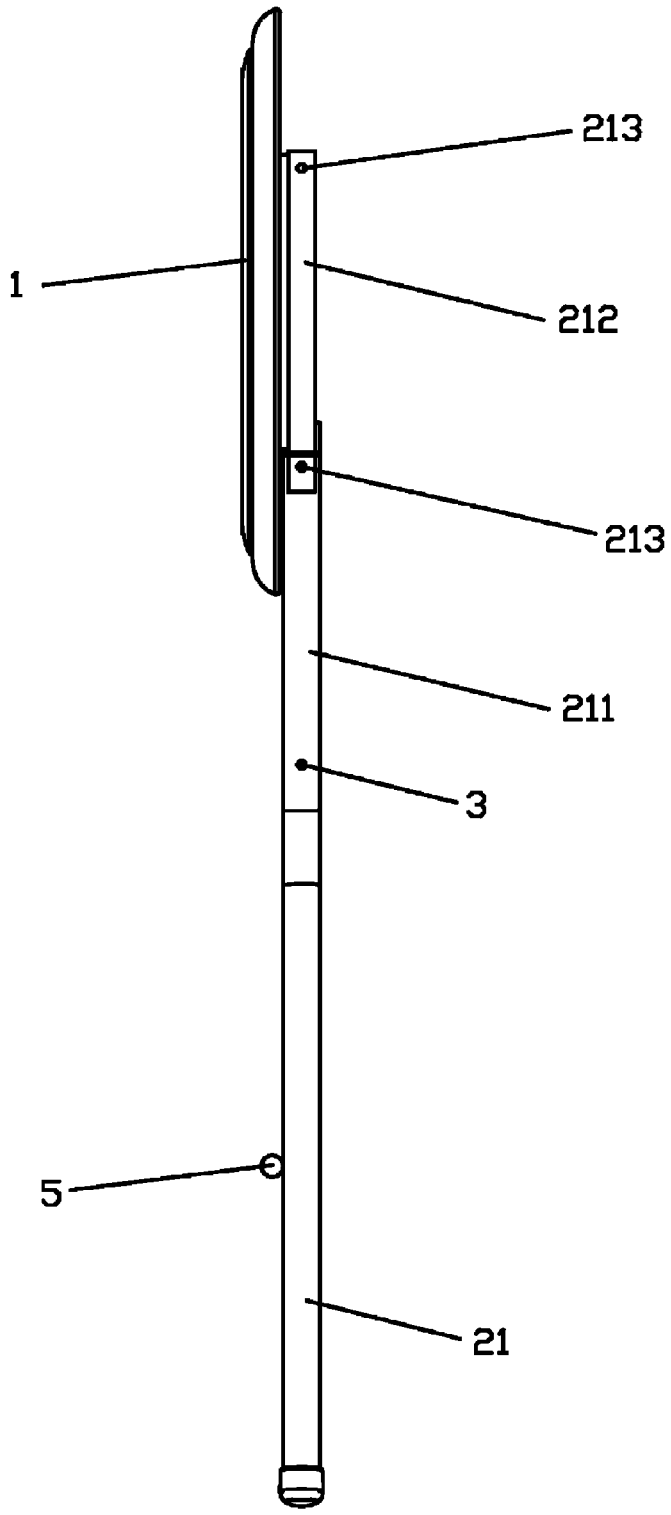
Figure 5:
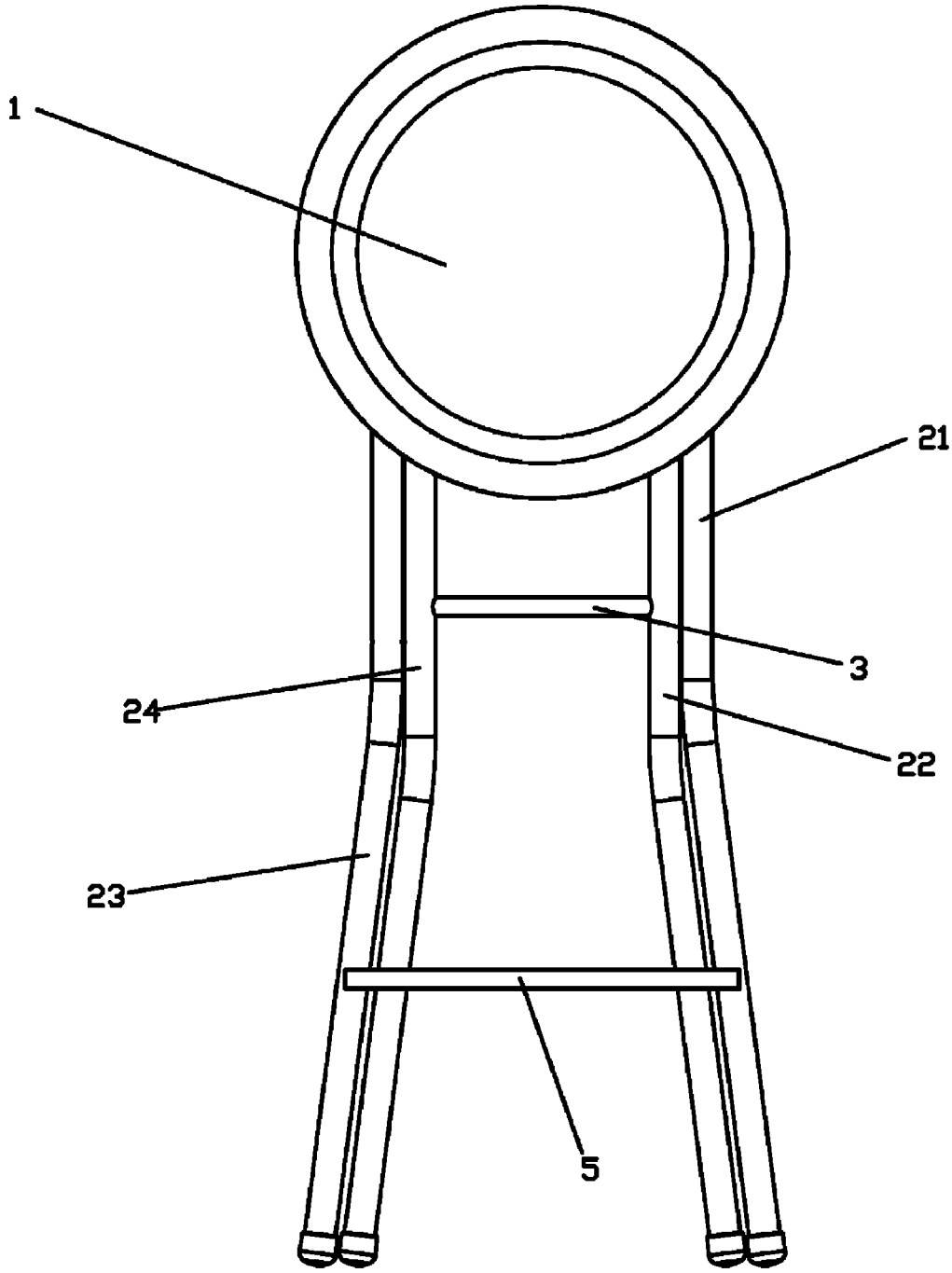
FIG. 5 is the front view of the stool in a folded position in a preferred embodiment of the present invention.

FIG. 3 and FIG. 4 are side views of the stool in a position of between folded and unfolded and a position of folded, respectively. Referring to FIG. 3, when the stool is to be folded, the sliding rod 212 in the leg 21 can be adjusted by the fixing apertures 213 and the screws, so that the sliding rod 212 slides out of the outer rod 211 upwards. Thus, the leg 22 can be moved close to the leg 21 gradually, and the seat 1 is folded downwards, because the seat 1 is hinged to the legs 21 and 22, and the connecting piece 11 is hinged to the leg 22. FIG. 4 is the side view of the completely folded stool, as shown in FIG. 4, when the stool is folded completely, the seat 1 is completely attach to the legs 21,22, and the legs 22 completely attach to the legs 21. Thus, only the leg 21, the cross bar 5 on the surface of the leg 21 and 23, and the seat 1 can be seen from this side view. That is, as shown in FIGS. 4 and 5, the ending points of the legs 21, 22, 23 and 24 are in the same plane when the stool is folded. The sliding rod 212 can be adjusted to the position as far as it can slide in the outer rod 211, i.e. it is far away from the cross beam 3, which is the furthest position to the cross beam 3. In this state, the stool is in a folded position. After been folded, the engaged space by the stool is decreased markedly, and because the length of the legs 21 and 22 are the same (i.e. the ending points of the legs 21 and 22 are aligned), the stool is convenient to be arranged, placed, stored and transported. The structures of 23,24 are the same as the legs 21,22, so they are not described repeatedly here.

FIG. 5 is the front view of completely folded stool in the present embodiment. As illustrated in the figure, only seat 1, four legs 21,22,23,24 hinged with the seat 1, a cross beam 3 and cross bar 5 can be seen. In this folded state, the engaged space by the stool is decreased markedly, and because the length of the legs 21 and 22 are the same as the legs 21,22, the stool is convenient to be placed.

In summary, the structure of the stool with the telescopic legs of the present invention is simple and easy to manufacture. The engaged space by the folded stool is decreased markedly, and thus it is very convenient to place, collect and transport the stool. Thus, the stool can be used widely.

The foregoing description of a preferred embodiment of the present invention has been presented for purposes of illustration and description. It is not intended to be exhaustive or to limit the invention to the precise form disclosed. All variations and modifications made in accordance with the patent application and the specification of the present invention, are within the scope of the present invention.

What is claimed is:

1. A stool with telescopic legs, comprising:

a seat and four legs including a first two legs disposed on a first side of the seat, and a second two legs disposed on a second side of the seat opposite to the first side, a first ending point of each of said four legs being hinged to the seat, the first two legs respectively pivotally crossing the second two legs, thereby forming two crossing joints, a cross beam connecting the two crossing joints, the second two legs each having a telescopic rod structure, wherein when the stool is folded, the telescopic rod structure extends, and second ending points of the first and second two legs opposite to the first ending points are aligned in a single plane, and wherein distances measured from each of the second ending points to a corresponding one of the crossing joints are identical.

2. The stool with telescopic legs according to claim 1, wherein said seat of the stool is of a circular, square, rectangular or elliptical shape.

3. The stool with telescopic legs according to claim 1, wherein said seat of the stool is hinged to each of the legs through a connecting piece mounted on a back of the seat of the stool by a rivet.

4. The stool with telescopic legs according to claim 1, wherein said telescopic rod structure includes:

a hollow outer rod;

a sliding rod which can slide inside the outer rod; and a screw thread connecting structure for fixing the sliding rod.

5. The stool with telescopic legs according to claim 4, wherein said screw thread connecting structure includes:

fixing apertures disposed both on the outer rod and the sliding rod; and screws used for locking the fixing apertures, the sliding rod and the outer rod.

6. The stool with telescopic legs according to claim 4, wherein each of the second two legs is connected to the seat via a connecting piece mounted on a back of the seat; and said sliding rod is hinged to a corresponding connecting piece by riveting.

7. The stool with telescopic legs according to claim 6, wherein a length of said sliding rod is longer than a distance between the cross beam and a corresponding connecting piece.

8. The stool with telescopic legs according to claim 4, wherein each of the second two legs is connected to the seat via a connecting piece mounted on a back of the seat; and a length of said sliding rod is longer than a distance between the cross beam and a corresponding connecting piece.

9. The stool with telescopic legs according to claim 1, further comprising a cross bar disposed between lower portions of said second two legs.

10. The stool with telescopic legs according to claim 9, further comprising another cross bar disposed between lower portions of said first two legs, a distance between the cross bar to the second ending points of the second two legs opposite to the seat being the same as a distance between the another cross bar to the second ending points of the first two legs opposite to the seat.

11. The stool with telescopic legs according to claim 1, further comprising a cross bar disposed between lower portions of said first two legs.

12. The stool with telescopic legs according to claim 1, wherein each of the legs is non-slidably hinged to the seat.

13. The stool with telescopic legs according to claim 1, wherein the telescopic rod structure is disposed between a corresponding crossing joint and the seat.

* * * * *